US006307308B1

(12) United States Patent
Teichmann et al.

(10) Patent No.: US 6,307,308 B1
(45) Date of Patent: Oct. 23, 2001

(54) LOW PRESSURE GAS DISCHARGE SWITCH WITH PARTICULAR ELECTRODE STRUCTURE

(75) Inventors: Jörg Teichmann, Alzenau; Michael Römheld, Uttenreuth, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/319,901

(22) PCT Filed: Dec. 5, 1997

(86) PCT No.: PCT/DE97/02848

§ 371 Date: Aug. 13, 1999

§ 102(e) Date: Aug. 13, 1999

(87) PCT Pub. No.: WO98/26441

PCT Pub. Date: Jun. 18, 1998

(30) Foreign Application Priority Data

Dec. 12, 1996 (DE) ..... 196 51 745

(51) Int. Cl.[7] ..... H01J 17/26; H01J 61/28

(52) U.S. Cl. ..... 313/231.11; 313/231.31; 313/231.41; 313/155; 313/161; 313/602; 313/604; 315/169.1; 315/169.3

(58) Field of Search ..... 313/231.11, 231.31, 313/231.41, 155, 161, 602, 604; 315/169.1, 169.3

(56) References Cited

U.S. PATENT DOCUMENTS 3,280,286 10/1966 Ranheim ..... 218/128
5,585,696 12/1996 Koyama et al. ..... 315/111.41

FOREIGN PATENT DOCUMENTS 34 26 323 1/1986 (DE) .
0 155 376 9/1985 (EP) .
0 381 843 8/1990 (EP) .
05 159 851 6/1993 (JP) .

OTHER PUBLICATIONS

"Triggerbare Hochleistungsschalter", Physik in unserer Zeit, 1991, pp. 156–164 Described in the Specification.

*Primary Examiner*—Vip Patel
*Assistant Examiner*—Kevin Quarterman
(74) *Attorney, Agent, or Firm*—Morrison & Foerster LLP

(57) ABSTRACT

At least main electrodes for a low pressure gas discharge arranged at a distance from each other are present in such switches, the main electrodes forming a cathode and an anode of a discharge path in an interrupter chamber for the gas discharge which is fired by increasing electron density in a cathode cavity. For this purpose, at least the cathodes have at least one opening, preferably the cathode and anode, having opposite aligned openings for triggering the discharge. In such an arrangement, an arrangement for the generation of a magnetic field superimposed on the discharge may be present. At least one slot is present in at least one of the main planar electrodes for generating a radial magnetic field. A single slot maybe provided which runs in the form of a spiral from the area of the electrode center to the area of the electrode edge.

16 Claims, 5 Drawing Sheets

LOW PRESSURE GAS DISCHARGE SWITCH WITH PARTICULAR ELECTRODE STRUCTURE

TECHNICAL FIELD OF THE INVENTION

The invention relates to a low pressure gas discharge switch, and in particular, to a low pressure gas discharge switch in which at least two main planar electrodes are arranged at a distance d from each other and are present for a low pressure gas discharge.

BACKGROUND OF THE INVENTION

According to the printed publication, "Triggerbare Hochleistungsschalter" [Triggerable Heavy-Duty Circuit Breakers] from "Physik in unserer Zeit" (1991), 4, pages 156 to 164, triggered switching of high current pulses, e.g., 10–100 kA, and long duration, e.g., up to 100 $\mu$s, at voltages above 10 kV with low pressure gas discharge switches (e.g., thyratron, ignitron, pseudospark switch) is used, for example, in pulsed high-power lasers, in fusion and acceleration technology, in medical engineering and in materials processing. The high charge transfer rates of up to 10 As per switching operation required for these switching operations results in a high local thermal load on the electrodes of the switch, since in most cases the plasma remains in the close vicinity of its firing point and consequently only a spatially limited segment of the electrodes are used for generating and maintaining the necessary dense plasma. This thermal load results in an increased erosion of electrode material, which finally results in a severely limited service life of the switches.

Triggered switching of long current pulses has been achieved with low pressure gas discharge switches. In this connection, up to approximately $10^8$ switching operations and consequently usual service lives were obtained with the pseudospark switch, for example. Depending on the design, a very long service life can be obtained with the ignitron; however, it has important disadvantages in relation to the pseudospark switch: Lower rate of current rise, e.g., $<10^{10}$ A/S compared with $\approx 10^{12}$ A/S for the pseudospark switch, high sensitivity to voltage reversal and to excessively high ambient temperatures as well as the hazards to the environment that arise when the mercury used as the electrode material is released when the switch is shattered.

Japanese Patent Application No. 51-59851 describes a means for generating a magnetic field superimposed on the discharge in a gas discharge switch. In particular, an axial magnetic field is superimposed on the arc discharge by an appropriate design of the current paths.

Concepts for generating magnetic fields specially superimposed on a switching arc are known from vacuum switching technology. Slotting the pot-shaped supply leads to the contacts results in magnetic fields acting on the switching plasma, which either ensure that the contraction of the plasma is counteracted and the plasma remains diffuse, as in the case of the axial field contacts according to European Patent No. 0 155 376 B1 or that the plasma, as a constricted arc, is set in rotational motion, as in the case of the radial field contacts described in German Patent No. 34 26 323 B1. The latter can also be achieved by slotting the electrode surfaces, by which the so-called spiral contacts are defined. In doing so, three to six slots, for example, are made in the electrodes. Driven by the Lorentz force, the switching arc proceeds on a nearly circular path.

In a similar manner, U.S. patent application No. 3,280,286 brings about the formation of current paths for generating a radial field by slotting the switch contacts.

SUMMARY OF THE INVENTION

In vacuum switches, the arc must commutate across the slots during its motion due to the slot geometry of the contacts. In this connection, the number of the commutation operations per revolution of the arc is equal to the number of slots. Commutation always has a negative effect on the motion of the arc, since the arc requires a certain amount of time for the commutation. In the most unfavorable case, this commutation time is greater than the actual switching time so that a local thermal overload of the electrode can occur caused by a standstill of the arc.

An object of the present invention is to set the plasma of a low pressure gas discharge switch in motion by suitable means so that the erosion of the electrode material is minimized.

This object is attained according to the present invention by at least one slot being present which delimits an effective current path being present in at least one of the main planar electrodes in a gas discharge switch of the type named above as a means of generating a radial magnetic field and that at least one trigger opening is located outside the electrode center in the current path. Preferably, a single slot is present which runs in a spiral form from the area of the electrode center to the area of the electrode edge.

With the present invention, a gas discharge switch is devised which is especially suitable for pulsed applications. In particular, as a result of the preferable design with a single slot, a magnetic field with a large radial component is generated by the current that is thus forced to flow in a spiral form, the magnetic field setting the switching plasma in a circular or spiral motion via the Lorentz force. In this connection, depending on the embodiment, the commutation of the switching plasma via a slot can be completely avoided or at least be reduced to one commutation operation per revolution. Accordingly the special slot geometry brings about a motion of the plasma which is more uniform than in conventional spiral contacts having several slots in vacuum switching technology.

An advantage in the slot geometry according to the invention is a particularly high radial magnetic field with electrode:

1. Triggering and contacting at the electrode edge: In this case, the radial component of the Lorentz force acting on the plasma is directed inwards; the plasma is moved on the spiral path toward the electrode center. This embodiment of the invention can be used to advantage in time-limited pulse durations when the arc time is less than the burn time of the plasma. Otherwise, the arc would temporarily burn locally in the center of the electrode and cause a very high thermal load there.

2. Firing and contacting in the area of the electrode center: In this case, the radial component of the Lorentz force on the plasma is oriented in the direction of the electrode edge; the plasma is moved outward on the spiral path. The plasma path passes over into a possibly single-slotted, circular path along the electrode edge. Due to the closed circular path on the electrode edge, this embodiment of the invention advantageously permits the switching of long (ms) pulses.

DETAILED DESCRIPTION OF THE INVENTION

Figure 1:
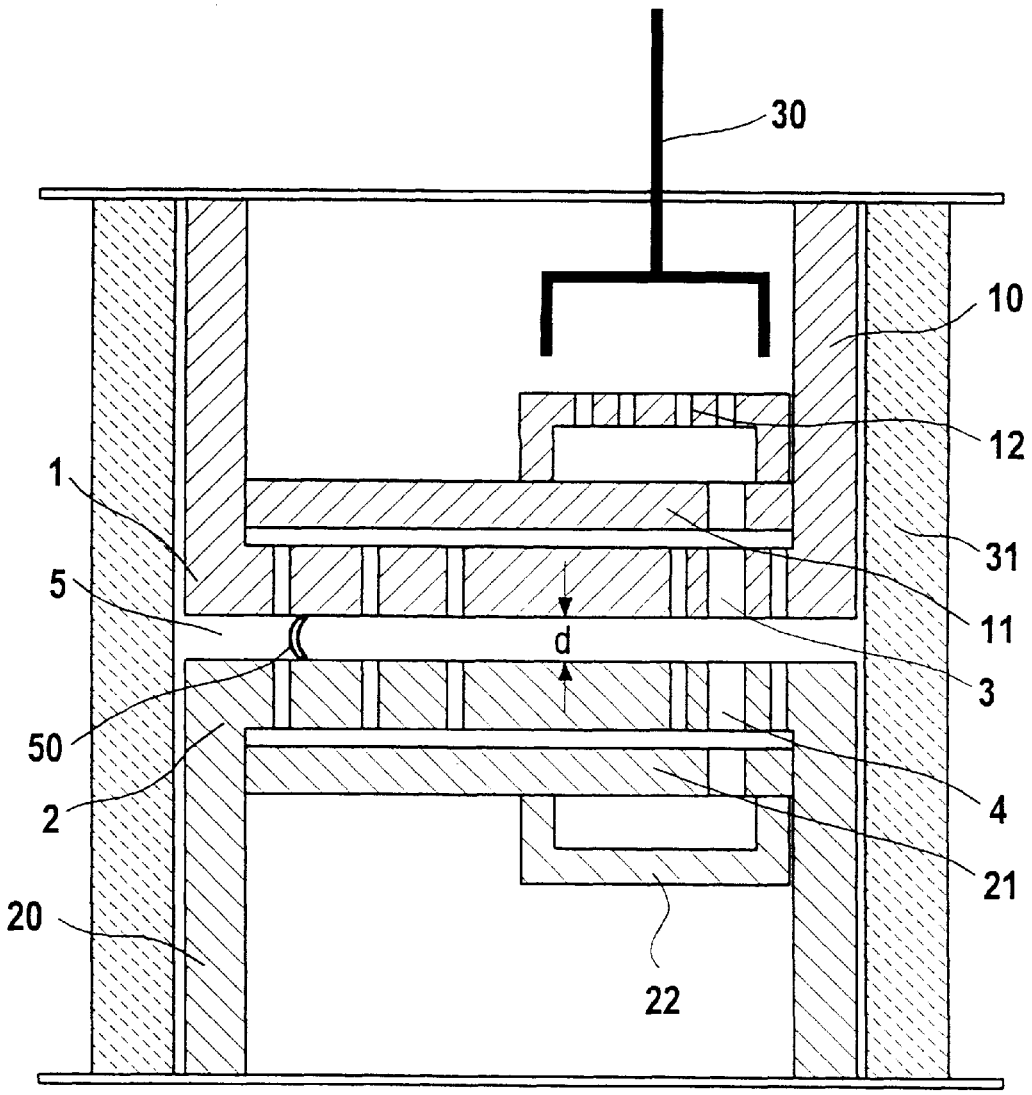
FIG. 1 shows a schematic design of a low pressure gas discharge switch having two spiral contact electrodes with external contacting and direction of travel of the discharge plasma to the inside.

Identical parts or parts of identical action are provided with the same reference symbols in the drawings. The figures are occasionally described jointly.

The invention relates to a low pressure gas discharge switch in which at least two main planar electrodes are arranged at a distance d from each other and are present for a low pressure gas discharge. The main electrodes comprise a cathode and an anode of a discharge path for the low pressure gas discharge in an interrupter chamber. The low pressure gas discharge is fired by an increase of the electron density in a cathode cavity, the cathode having at least one opening, preferably the cathode and anode having opposite aligned openings, for triggering the discharge, and means being present for the generation of a radial magnetic field superimposed on the discharge.

Figure 4:
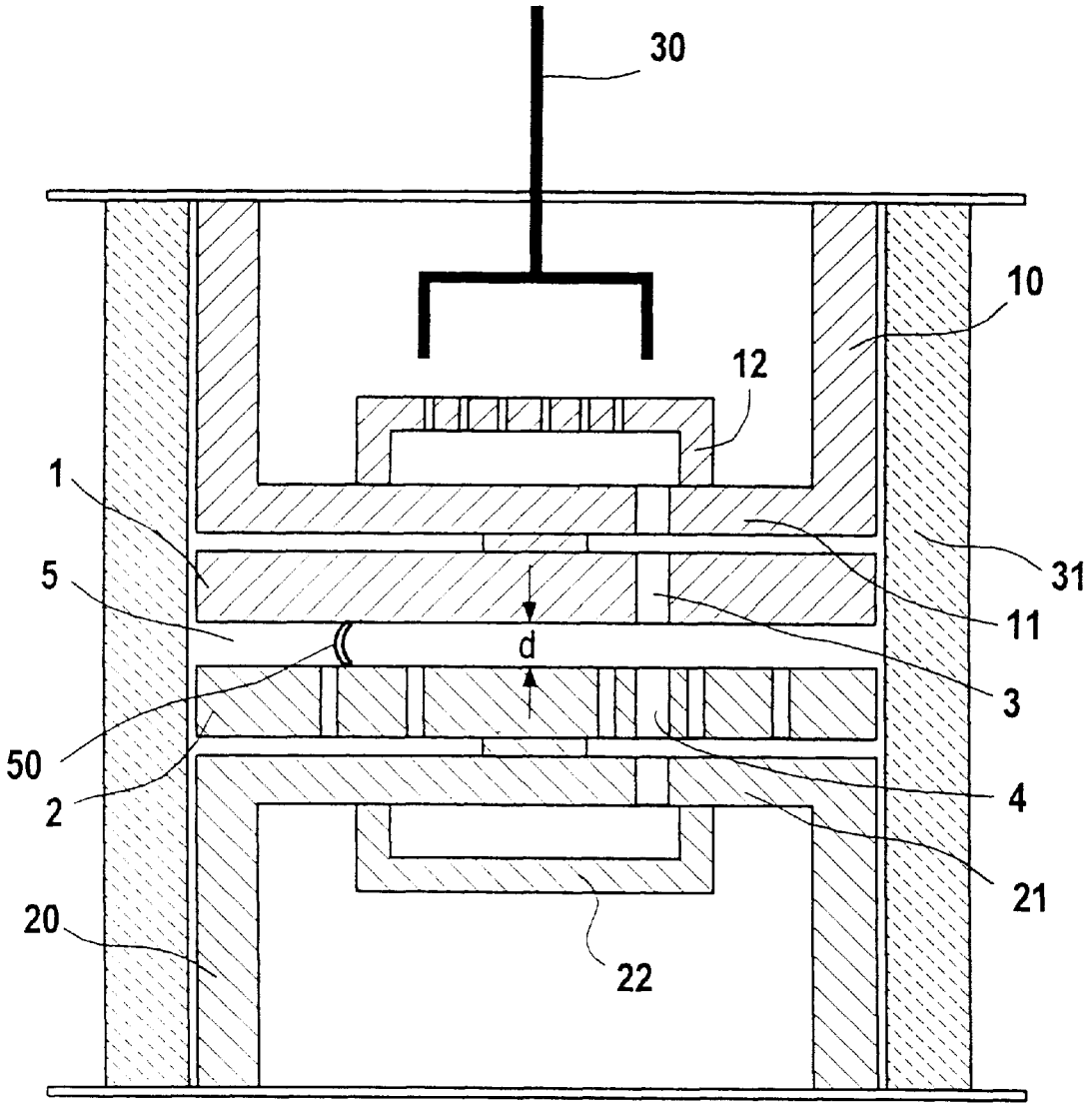
FIG. 4 shows a design of a low pressure gas discharge switch alternative to FIG. 1 with central contacting and direction of travel of the discharge plasma to the outside.

In FIG. 1 and FIG. 4, a cathode of a gas discharge switch is identified as 1 while an anode is identified as 2. Cathode 1 and anode 2 form the main electrodes of the gas discharge switch, which is shown in FIGS. 1 and 4 only in connection with the electrode structure. This means that, in particular, a ceramic container 31 and a gas reservoir, which normally must be present in a gas discharge switch, are only suggested and not described in detail. Measures can be taken in a conventional manner to protect the ceramic container from interaction with the discharge plasma or switching plasma.

In conventional, gas discharge switches, it is essential for an opening 3 to be present in at least the cathode; preferably, however, openings 3 and 4 are arranged in the cathode and in the anode, respectively so as to be in alignment, the openings being designated trigger holes and being separated from each other by a gap 5 as the actual discharge path. In the gas discharge switch, the supply leads for the main electrodes are formed as hollow electrodes. Specifically, they are each made up of cylindrical pots 10 and 20, which are placed on the backs of planar cathode 1 and anode 2, respectively, and contacted at a suitable location. One trigger protective screen 11 and 21 and an electrode cover 12 and 22 each is present in the hollow electrode arrangement. The trigger protective screens prevent the switching plasma from igniting at other locations outside the trigger openings. Electrode cover 12 within the hollow cathode is formed as a cage, i.e., it has openings on its back for entry of the gas and the charge carrier required for firing. The latter are moved in the rear in the direction of the hollow cathode with the aid of a trigger electrode 30 over it. Other trigger arrangements are possible.

Figure 2:
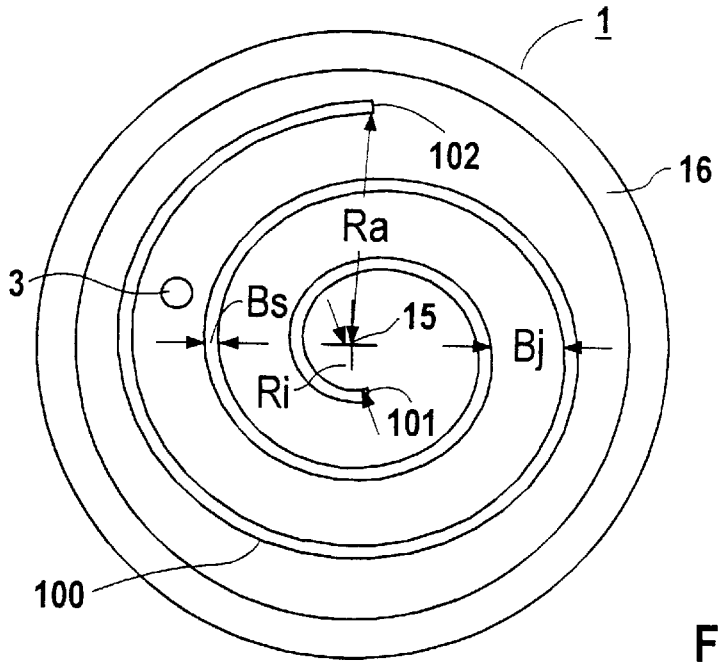
FIG. 2 and FIG. 3 each show a top view of the two spiral contact electrodes in FIG. 1.
Figure 3:
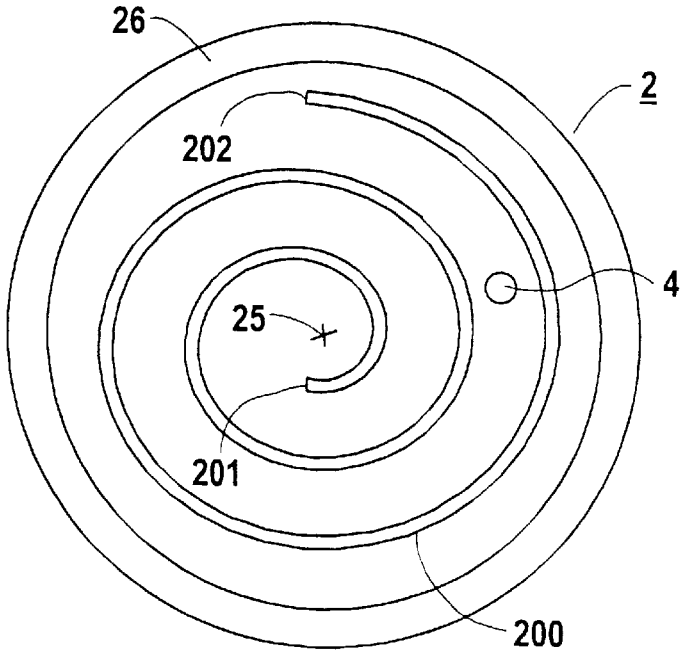

In FIGS. 1 to 3, the gas discharge switch is designed using slots in such a way that the direction of travel of the plasma is inward: Contacting between electrode discs 1, 2 and associated hollow electrode structures 10, 20 as supply leads occurs circumferentially on the outside edge 16, 26 and trigger openings 3, 4 are located in the edge area. According to FIGS. 2 and 3, a spiral slot 100 and 200 is made in each of discs 1 and 2, respectively, the spiral slot starting blind behind edge 16, 26 and running to the area of electrode center 15, 25. Consequently firing and contacting take place at the electrode edge and the discharge plasma is moved on the spiral path, i.e., on the surface, between slot 100, 200 to electrode center 15, 25, respectively.

Figure 5:
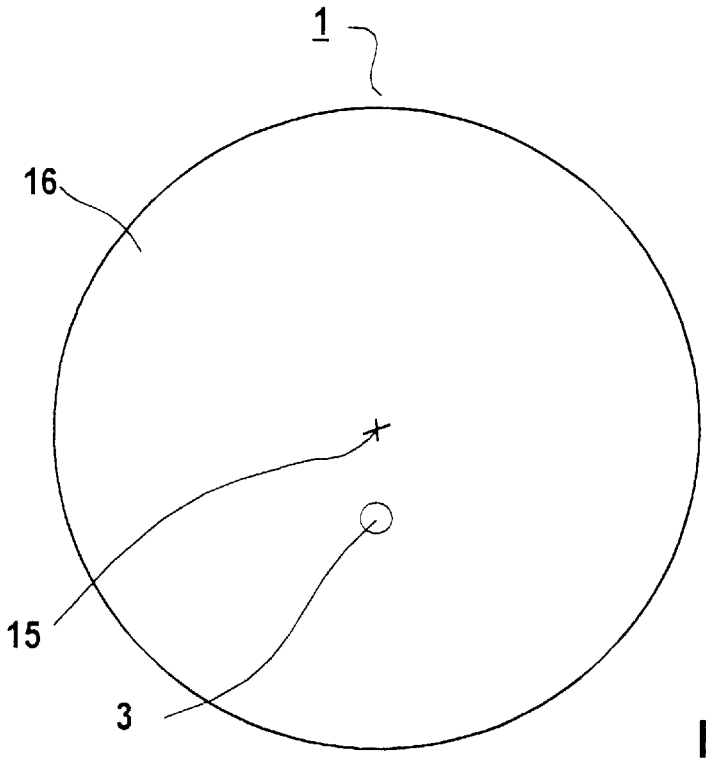
FIG. 5 shows a top view of the unslotted cathode in FIG. 4.
Figure 6:
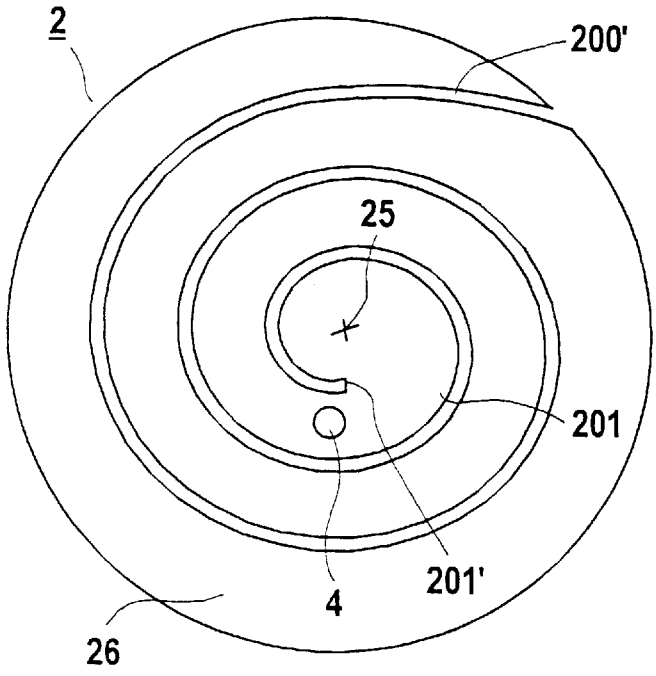
FIG. 6 shows a top view of the slotted anode in FIG. 4.

In FIGS. 4 to 6, the gas discharge switch is designed in such a way that the direction of travel of plasma 50 is from the inside to the outside: In this case, contacting between electrode discs 1, 2 and the associated hollow electrode structures takes place in electrode center 15, 25 by contact elements 13 and 23. Trigger openings 3 and 4 are located in the area of electrode center 15, 25, each closely adjacent to the point of contacting.

Slotting a single main electrode may be sufficient to generate a radial magnetic field. According to FIG. 5 and FIG. 6, slot 200' in this case is specially formed in anode 2 so that the firing takes place at trigger opening 4 in the area of electrode center 25 and discharge plasma 50 is moved from the inside to the outside on the spiral path between slot 200'.

In all cases, the slot geometry is essential. Specifically, an Archimedean spiral is suggested for which the following geometric conditions apply:

The circular discs according to FIGS. 2, 3 and 5, 6 are each provided with a slot in the form of a spiral of width $B_s$ in an area between an inner radius $R_i$ and an outer radius $R_a$. A spiral contour can be obtained by different means. The Archimedean spiral is described here as an example. In such a spiral, a current path of constant width $B_j$ is produced. The values for $R_i$, $R_a$, $B_s$, $B_j$ are as a rule determined by physical and production engineering circumstances. $R_i$ and $R_a$ are based on the external dimensions of the switch, which in turn result from the specifications for switching capacity. $B_s$, $B_j$ are derived from physical considerations. The width of the current path should, since it simultaneously forms the path of the plasma, always be selected to be at least large enough to provide sufficient area for maintaining the plasma; this is assured if the width of the current path is on the order of magnitude of twice the diameter of the trigger bore. Slot width $B_s$ must be dimensioned at least large enough to ensure reliable insulation of the adjacent current paths and to prevent fusing of the slots as a result of the interaction of the plasma with the electrodes.

Given the above-listed values, the number of the slot turns n can be calculated according to the following rule:

$$n = \frac{R_a - R_i}{B_s + B_j}.$$

The slot contours can be determined according to the following relationships:

1. Range of values of angle of rotation parameter ψ: $0 \leqq \psi \leqq 2n\pi$
2. Contour of the inner slot boundary with $p_1$ denoting the radius of the inner slotting:

| in polar coordinates | in Cartesian coordinates |
|---|---|
| $\varphi$ | $x_i = \rho_i \sin(\varphi)$ |
| $\rho_i = \frac{\varphi(R_a - R_i)}{2n\pi} + R_i$ | $y_i = \rho_i \cos(\varphi)$ |

3. Contour of the outer slot limitation with $p_2$ denoting the radius of the outer slotting:

| polar coordinates | Cartesian coordinates |
|---|---|
| $\varphi$ | $x_a = \rho_a \sin(\varphi)$ |
| $\rho_a = \frac{\varphi(R_a - R_i)}{2n\pi} + R_i + B_s$ | $y_a = \rho_a \cos(\varphi)$ |

When contacting takes place in the electrode center, slot 200' can either terminate before the electrode edge or be continued to the electrode edge in various ways, e.g., as a linear or circular arc-shaped extension according to FIG. 6. This continuation has the advantage of a higher magnetic field and a greater driving force. The disadvantage is that, with the circular motion on the electrode edge, the plasma must commutate via the slot, which in turn may lead to a standstill of the plasma. Whether or not the slot can or must be continued depends on the particular use parameters such as current intensity, gas pressure, switching time.

With contacting in the electrode center, it is moreover possible to ignite the discharge plasma in the vicinity of the electrode edge. As a result of the larger number of windings which the current passes on its way to the firing point, an enhanced magnetic field is obtained. However, this results in the portion of the electrode surface exposed to the plasma being diminished, which increases the thermal load of this portion.

Figure 7:
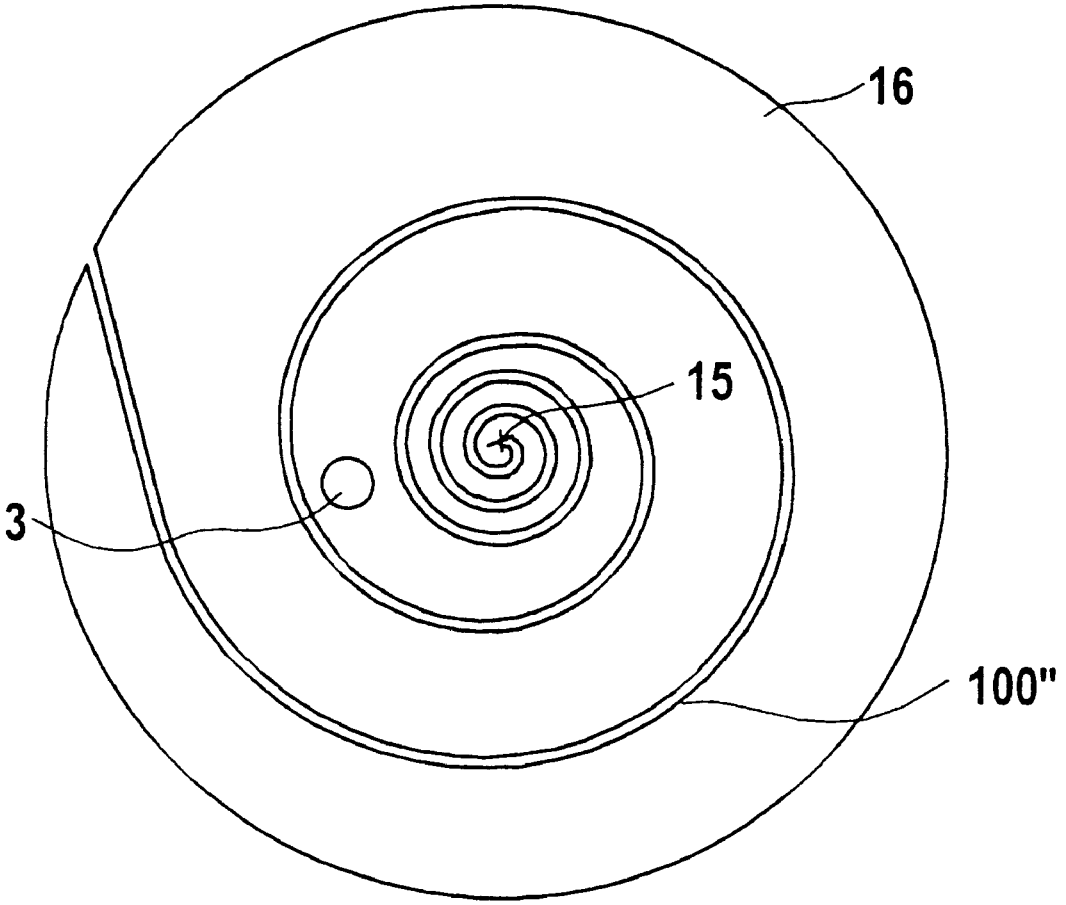
FIG. 7 shows a top view of a spiral contact electrode with variable width of the current path and direction of travel of the discharge plasma from inside to outside.

A spiral current path of varying width according to FIG. 7 represents a compromise with regard to these different effects. Since the plasma is prevented from burning on the segment from the contact site to the trigger bore, the current path can be kept correspondingly narrow in this segment. At the same time, however, the dimension of the current path width is limited downwards by thermal overload as a result of resistive heating, by mechanical stability and by production engineering aspects. The area from the trigger bore to the electrode edge serves at the same time as the path of the plasma. This segment of the current path must therefore be selected to be wider, e.g., approximately twice the diameter of the trigger opening.

In FIGS. 1 to 7, separate trigger openings are present in each case as bores outside the slot 100". It is also possible to define the trigger opening by a specific slot area as long as this slot area is limited by an insulator on both sides.

What is claimed is:

1. A low pressure gas discharge switch, comprising:

main planar electrodes arranged at a distance from each other, the main planar electrodes including a cathode and an anode of a discharge path for a discharge plasma in an interrupter chamber, the cathode having at least one trigger opening, the discharge plasma being ignited by increasing an electron density in the at least one trigger opening of the cathode, the at least one trigger opening of the cathode being located outside an electrode center in a current path;

at least one slot provided in at least one of the main planar electrodes limiting the current path and generating a radial magnetic field superimposed on the discharge plasma.

2. The low pressure gas discharge switch according to claim 1, wherein the anode includes at least one opening, the at least one opening of the anode being aligned opposite to the at least one trigger opening of the cathode.

3. The low pressure gas discharge switch according to claim 1, wherein the at least one slot is a single slot which extends in a form of a spiral from an area of the electrode center to an area of an edge of the at least one of the main planar electrodes.

4. The low pressure gas discharge switch according to claim 1, wherein the at least one slot includes one spiral slot in each of the main planar electrodes and that both of the slots run equidirectionally in a functional position of the main planar electrodes.

5. The low pressure gas discharge switch according to claim 3, wherein the at least one of the main palanar electrodes is contacted on the edge, firing of the discharge plasma taking place at at the edge so that the discharge plasma travels in a form of a spiral from the trigger opening in a direction of the electrode center, the trigger opening being located close to the edge.

6. The low pressure gas discharge switch according to claim 5, wherein the firing of the discharge plasma takes place in an area of an outer portion of the at least one slot.

7. The low pressure gas discharge switch according to claim 3, wherein the at least one of the main planar electrodes is contacted in an electrode center, firing of the discharge plasma taking place at the electrode center so that the discharge plasma travels in a form of a spiral from the at least one triggering opening of the cathode in a direction of the electrode center, the at least one trigger opening of the cathode being located close to the electrode center.

8. The low pressure gas discharge switch according to claim 7, wherein the firing of the discharge plasma takes place in an area of an inner slot end away from the electrode center.

9. The low pressure gas discharge switch according to claim 7, wherein with contacting in the electrode center, the at least one slot is continued to the edge.

10. The low pressure gas discharge switch according to claim 7, wherein the at least one slot terminates blind in the edge so that the discharge plasma rotates via the at least one slot on the edge without commutation.

11. The low pressure gas discharge switch according to claim 3, wherein contacting takes place in the electrode center, and the discharge plasma is fired in a vicinity of the edge.

12. The low pressure gas discharge switch according to claim 3, wherein the at least one slot forms a circular spiral in a surface of the at least one of the main planar electrodes.

13. The low pressure gas discharge switch according to claim 1, wherein the at least one slot is shaped so that current paths on which the discharge plasma does not flow are narrower than the current paths on which the discharge path flows.

14. The low pressure gas discharge switch according to claim 1, further comprising:

an arrangement preventing firing of the discharge plasma via the at least one slot.

15. The low pressure gas discharge switch according to claim 1, further comprising:

a trigger protection screen positione d behind each of the ma in planar electrodes.

16. The low pressure gas discharge switch according to claim 3, wherein each of the at least one trigger opening includes an area of the at least one slot and is delimited by an insulator.

* * * * *